United States Patent [19]

Hase et al.

[11] Patent Number: 4,642,913

[45] Date of Patent: Feb. 17, 1987

[54] SPORTS SHOES

[75] Inventors: Yoshiaki Hase, Akashi, Japan; Toshio Shigi, Irvine, Calif.

[73] Assignee: ASICS Corporation, Kobe, Japan

[21] Appl. No.: 638,060

[22] Filed: Aug. 6, 1984

[30] Foreign Application Priority Data

Apr. 12, 1984 [JP] Japan ..... 59-54270[U]

[51] Int. Cl.[4] ..... A43B 11/00; A43C 1/00

[52] U.S. Cl. ..... 36/50

[58] Field of Search ..... 36/50, 45, 114, 126, 36/127, 128, 129, 113, 58.5; 24/117, 140, 141; D2/309, 310, 275

[56] References Cited

U.S. PATENT DOCUMENTS

| | | | |
|---|---|---|---|
| D. 277,615 | 2/1985 | Gamm | D2/275 X |
| 1,466,075 | 8/1923 | Triay, Jr. | 24/140 |
| 1,466,078 | 8/1923 | Washburn | 24/140 |
| 4,255,876 | 3/1981 | Johnson | 36/45 X |
| 4,413,431 | 11/1983 | Cavanagh | 36/45 X |

FOREIGN PATENT DOCUMENTS

| | | |
|---|---|---|
| 817 | 1/1972 | Japan . |
| 22459 | 7/1975 | Japan . |
| 14112 | 1/1979 | Japan . |
| 44486 | 10/1980 | Japan . |
| 36922 | 8/1981 | Japan . |
| 32724 | 7/1982 | Japan . |
| 52043 | 11/1982 | Japan . |

OTHER PUBLICATIONS

Boot and Shoe Recorder, Feb. 1972, p. 26.
Japanese Design Gazette No.: Similar Design 2 of Japanese Design Gazette No. 573654/1982.
Japanese Design Gazette No. 589595, 1982.
Japanese Design Gazette No. 492983, 1983.
Japanese Design Gazette No. 573654, 1982.
Japanese Design Gazette No.: Similar Design 1 of Japanese Design Gazette No. 573654/1982.

*Primary Examiner*—Werner H. Schroeder
*Assistant Examiner*—Trucy Graveline
*Attorney, Agent, or Firm*—Lyon & Lyon

[57] ABSTRACT

Sports shoes having a string passage aperture and a string passage ring, each of which are arranged at both sides of a forward opening of an upper cover, opposing to each other and along a longitudinal direction of the shoe in order to engage a shoe string and tightly close the forward opening, in which the string passage ring is adapted to engage the shoe string more smoothly as compared with the string passage aperture, each pair of the string passage rings disposed opposing to each other at both sides of the forward opening being arranged alternating with the pair of the string passage apertures.

12 Claims, 3 Drawing Figures

SPORTS SHOES

BACKGROUND OF THE INVENTION

This invention relates to sports shoes adapted to tightly clamp the upper cover by means of a shoe string.

Conventional sports shoes generally known so far adapted to tightly close the forward opening in the upper cover include those types in which a plurality of string passage apertures are perforated at an equi-distance along both side edges of the forward opening for tightening a shoe string through the string passage apertures, or in which ring-like members of a relatively large size, for example, of a D-shaped configuration, are provided on the upper cover instead of the string passage apertures for tightening the shoe string.

However, the former type sports shoes adapted to tie the shoe string by means of the string passage apertures are disadvantageous in that although a sufficient tension of the shoe string obtained by the tightening can be exerted only at the upper end of the forward opening in the upper cover, that is, only at a portion near the tying position of the shoe string an intense tightening effect is available, such a tension by the tightening of the shoe string can not smoothly be transmitted to a portion near the toe of the shoe and accordingly, tightening effect can not be readily obtained throughout the entire portion of the upper cover. This is attributable to the fact that a shoe string inserted through the string passage apertures and engaging their bore edges is hindered from smooth sliding due to the frictional resistance, as well as the fact that a portion of the shoe string near the string passage apertures is forcibly put between the upper cover and a tongue-like inner pad member to further hinder the smooth sliding of the shoe string, thereby making it more difficult to transmit the tightening effect obtained by the tying of the shoe string to the toe portion of the shoe.

Accordingly, there has been a drawback in this type of the sports shoes that the uniform tightening effect by tying the shoe string is difficult to obtain throughout the upper cover and that no well-balanced tightening effect can be attained with ease by prevailing the tension of the shoe string obtained by the tightening of it over the entire portion of the forward opening, although it has a merit that the shoe string once tightened by the tying would not be readily loosened even if a shoe wearer takes exercise with vigorous footwork.

While on the other hand, in the latter type of the sports shoes adapted to tie a string by the ring-like members, since each ring-like member for inserting the shoe string is formed with a large bore, made of highly smooth material with less frictional resistance such as metal or plastic and often shaped in a semi-circular or elliptic configuration, the shoe string engaging the bore edge of the ring-like member is not hindered from smooth sliding. Accordingly, in the sports shoes of the latter type, the tightening force obtained by the tying of the shoe string can be well transmitted from the tying position of the shoe string to the vicinity of the toe to exert an effective clamping effect all over the upper cover. On the contrary, shocks due to the wearer's vigorous movement are liable to extend on the tying position of the shoe string, which are directly transmitted throughout the upper cover to rapidly cancel the tightening force by the tying of the string.

This invention has been made in view of the foregoing defects in sports shoes of the type adapted to tie a shoe string by string passage apertures, as well as by another type provided with highly smooth ring-like members.

It is an object of this invention to provide sports shoes, wherein the tightening force obtained by the clamping of a shoe string can be transmitted substantially over the entire portion of the upper cover, which is not lost rapidly, but can provide a long lasting satisfactory tightening force.

DESCRIPTION OF THE ACCOMPANYING DRAWINGS

These and other objects, as well as the advantages of this invention will be made clearer by reading the following detailed descriptions in conjunction with the appended drawings, in which FIG. 1 is a plan view of a preferred embodiment of sports shoes according to this invention, FIG. 2 is a schematic plan view of an eyelet-forming piece in another embodiment of the sports shoes according to this invention, and FIG. 3 is a plan view of sports shoes mounted with the eyelet-forming piece shown in FIG. 2.

DESCRIPTION OF PREFERRED EMBODIMENT

Figure 1:
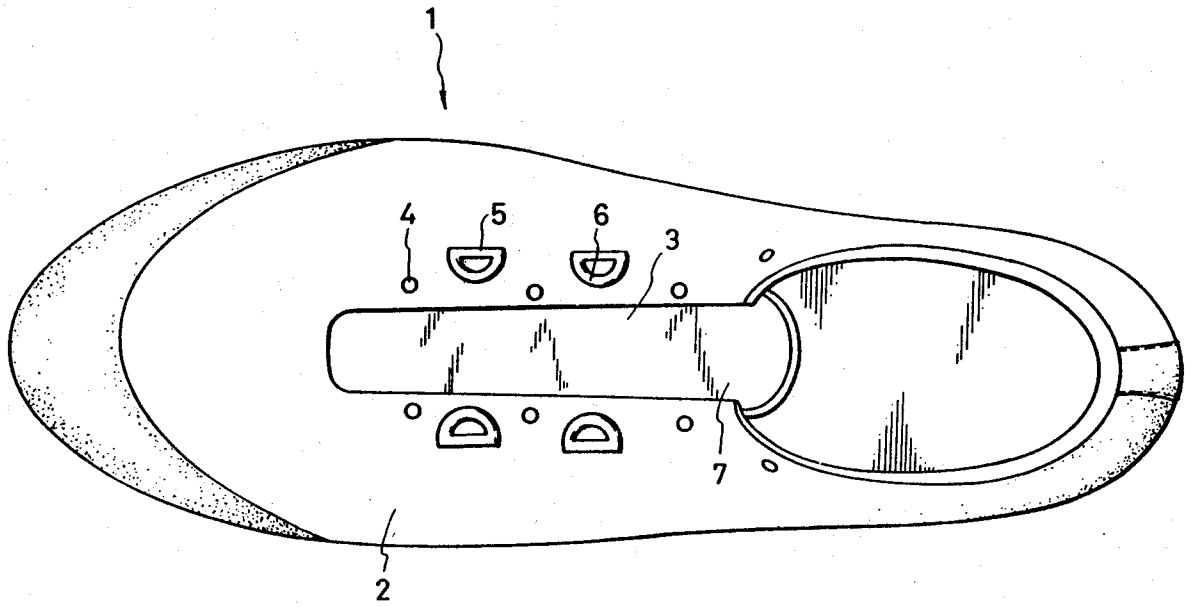

FIG. 1 shows a preferred embodiment for sports shoes according to this invention, in which a sports shoe 1 has a forward opening 3 formed in an upper cover 2. On both sides of the forward opening 3, are arranged string passage apertures 4 as first engaging means and string passage rings 5 as second engaging means which are arranged alternately along the longitudinal direction of the shoe 1. Each of the string passage apertures 4 are disposed in opposing pairs and each of the string passage rings 5 is also disposed in opposing pairs. The string passage apertures 4 may be formed in small apertures capable of passing a shoe string while keeping it in contact with the bore edge of the string passage apertures 4 perforated through the upper cover 2. The bore periphery of the string passage aperture 4 may or may not be mounted with an annular member made of plastic material or the like. The string passage apertures 4 are preferably perforated at least at the uppermost end part of the upper cover 2 as shown in FIG. 1.

Each of the string passage rings 5 has a bore diameter much larger than that of the string passage aperture 4 in the shape of a D-like configuration and is made of highly smooth material such as plastic or metal. While the shape of the string passage ring 5 is not restricted only to the D-like configuration but may be in any other shapes such as a circle or the like, it is preferred that a portion 6 thereof engaging the shoe string has cross section of a rounded shape such as a circle or an ellipse. The string passage ring 5 is fixedly attached on a large bore periphery perforated in the upper cover 2. Or the string passage ring 5 may be attached on the upper cover 2 in such a manner that the string passage ring 5 can be separated from the upper cover 2 while being secured to the upper cover 2 by way of a pin or the like. In the latter case, it is preferred that the string passage ring 5 is mounted on the upper cover 2 such that at least its portion 6 engaging the shoe string may be movable relative to the upper cover 2. The string passage rings 5, as well as the string passage apertures 4, are arranged in pairs on both side edges of the forward opening 3 so that each pair of them are opposed to each other. A tongue-like inner sheet member 7 is disposed below the upper cover 2, and the shoe string inserted through the string passage apertures 4 is restrained from sliding movement by the frictional engagement with the bore edges of the string passage apertures 4, as well as by being put between the rear face of the upper cover 2 and the surface of the inner sheet 7.

In the sports shoe according to this invention, opposing pairs of the string passage apertures 4 and the D-shaped string passage rings 5 are arranged alternately on both side edges of the forward opening 3 in the upper cover 2. Therefore, when a wearer ties a shoe string, the tightening force of the shoe string is readily transmitted by way of the string passage rings 5 to the toe portion of the upper cover 2. Further since the tightening force transmitted through the string passage rings 5 is properly controlled from loosening by the string passage apertures 4, if the shoes wearer takes exercise with vigorous footworks, slackening in the shoe string does not rapidly extend to the tying position of the shoe string. Thus, sports shoes capable of attaining an appropriate tightening effect for the upper cover by the clamping of the shoe string is provided according to this invention.

Figure 2:
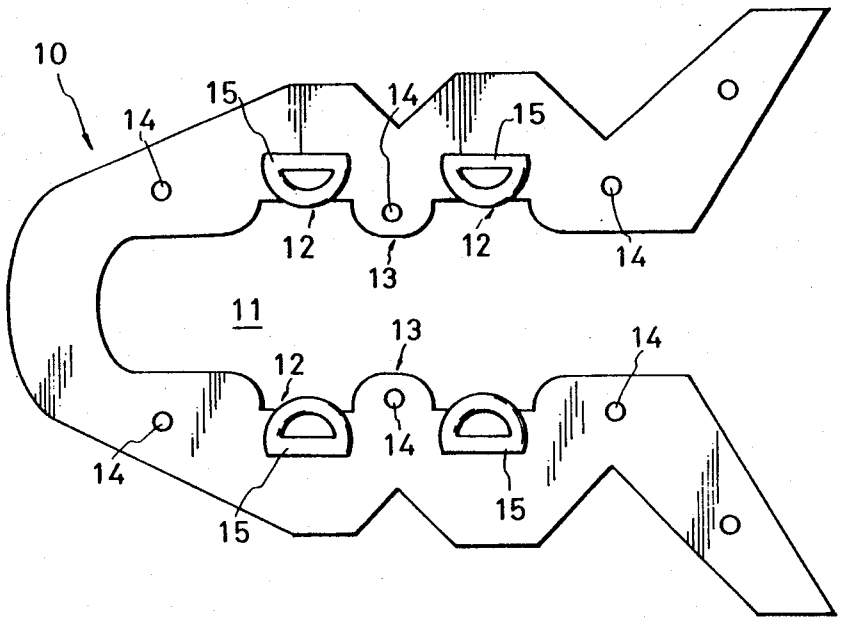
Figure 3:
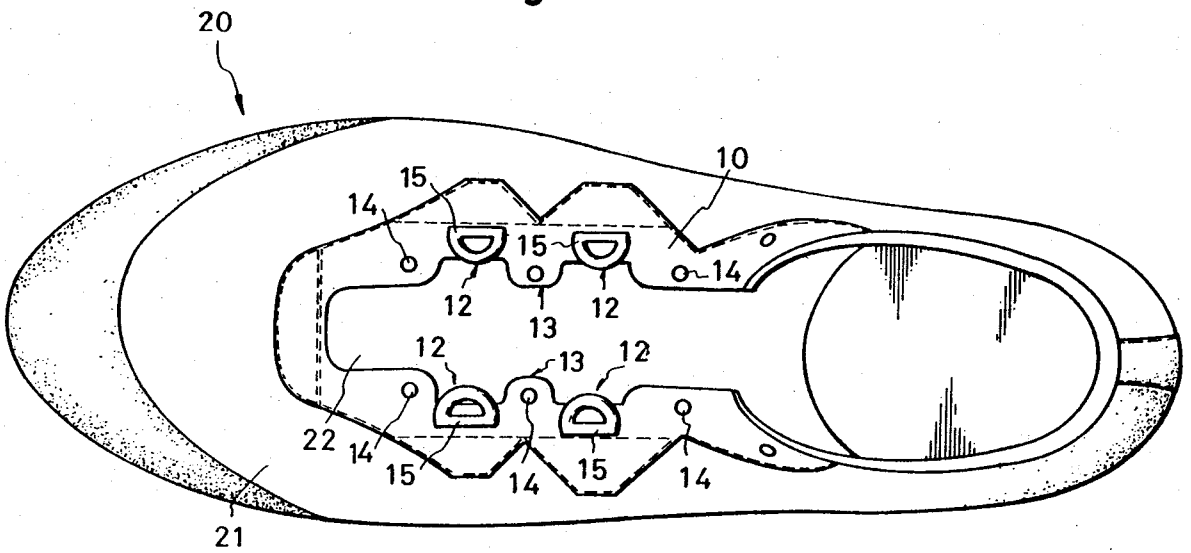

FIG. 2 and FIG. 3 show another preferred embodiment of sports shoes according to this invention, wherein an eyelet-forming piece 10 provided with string passage apertures and string passage rings, as shown in FIG. 2, is secured to the both side edges of the forward opening in the upper cover.

The eyelet-forming piece 10 has an opening 11 formed in a shape suitable for a forward opening 22 of a sports shoe 20, and recesses 12 and protrusions 13 are alternately formed on the inner side edges of the opening 11 along the longitudinal direction of the upper cover 21. String passage apertures 14 as first engaging means are perforated in the protrusions 13 and string passage rings 15 as second engaging means are disposed along the recesses 12 of the eyelet-forming piece 10. Thus, the D-shaped string passage rings 15 are arranged on the outer side of the string passage apertures 14 with respect to the opening 11. The eyelet-forming piece 10 having such a constitution is secured to the upper cover 21 of the sports shoe 20 by means of stitching, bonding or the like as shown in FIG. 3.

In the embodiment shown in FIG. 3, since the string passage rings 15 are arranged at least on the outer side of the string passage apertures 14 with respect to the forward opening 22 in the upper cover 21, the width of each opposing pairs of the string passage rings 15 is larger, and therefore increases the effective clamping width for the string passage rings 15 in the forward opening 22 when the shoe string is inserted therethrough. Accordingly, a sufficient tightening effect by the clamping of the shoe string can be obtained if the present embodiment is applied to a foot with a low instep height. That is, to people having feet of such type, there remain a large gap, at the time of putting the shoe, between the instep of the foot and the forward opening of the upper cover before tying the shoe string and the space in the forward opening is instantly closed by the tying of the shoe string to make the tightening effect by clamping ineffective.

Furthermore, for a wearer having feet with a great instep height, the string passage apertures 14 disposed at the recesses 13 formed along the inner edges of the eyelet-forming piece 10 can properly function and obtain an effective tightening force.

As described above, the sports shoes according to this invention have two conflicting advantageous features together, that is, the tightening force obtained by clamping of the shoe string can be transmitted throughout the upper cover by the string passage rings as second engaging means, also slackening in the tension of the shoe string can be prevented by the string passage apertures as first engaging means. Moreover, the modified embodiment of this invention can provide a satisfactory tightening effect when it is applied to wearers of various foot styles including those of high and low foot insteps, whereby comfortable feelings of putting the shoes can be provided for wearers. Furthermore, since the string passage apertures and the string passage rings of different configurations are alternately arranged on the eyelet-forming piece in combination, sports shoes of much varied designs can be available to provide more aesthetic appearance to the shoes. This invention can be applied desirably to all sorts of shoes such as for use in so-called jogging exercise which become remarkably popular in recent years and can provide shoes of an extremely great practical value.

What is claimed is:

1. A sports shoe comprising first engaging means having at least two contacting points and second engaging means having at least one contacting point, said first and second engaging means being arranged at each of two side portions of an upper cover means of the shoe having a forward opening which is opened at a fore part of said upper cover means along a longitudinal direction of the shoe, both the side portions being opposed to each other along the longitudinal direction of the shoe and both the side portions being disposed in the vicinity of both side peripheral edges of the upper cover means, the edges profiling the forward opening, the side portions each having an uppermost part adjacent to the forward opening, and a lowermost part adjacent to the forward opening, the lowermost part being forward of the uppermost part with respect to the longitudinal direction, the contacting points of the second engaging means being adapted to engage a shoe string more smoothly as compared with the contacting points of the first engaging means, the one contacting point of the second engaging means being arranged adjacent to each of the two contacting points of the first engaging means and between the two contacting points of the first engaging means along each of the side portions, the contacting points of the first engaging means at one of the side portions being arranged so as to oppose the contacting points of the first engaging means at the other side portion, and further the contacting point of the second engaging means at the one side portion being arranged so as to oppose the contacting point of the second engaging means at the other side portion, whereby the contacting points of the first and second engaging means are laced by a shoe string and a uniform and well-balanced tightening effect throughout a substantial part of the side portions is obtained by tying both ends of the shoe string after engaging the shoe string with the contacting points of the first and second engaging means arranged along each of the side portions.

2. The sports shoe of claim 1, in which the upper cover means comprises an upper cover and an eyelet-forming piece secured to the upper cover.

3. The sports shoe of claim 1 in which the upper cover means has a first protrusion projecting from one side portion to the other side portion, a second protrusion projecting from the other side portion to the one side portion so as to oppose the first protrusion, a third protrusion projecting from the one side portion to the other side portion and adjacent to the first protrusion along the longitudinal direction, and a fourth protrusion projecting from the other side portion to the one side portion so as to oppose the third protrusion, and the contacting points of the first engaging means are disposed on the first, second, third, and fourth protrusions.

4. The sports shoe of claim 3, in which a distance between the contacting point of the first engaging means at one side portion and the opposing contacting point of the first engaging means at the other side portion is more narrow than a distance between the contacting point of the second engaging means at one side portion and the opposing contacting point of the second engaging means at the other side portion.

5. The sports shoe of claim 1 or 4, in which the contacting points of the first engaging means comprise string passage apertures located on the side portions.

6. The sports shoe of claim 5, in which the contacting points of the second engaging means comprise string passage rings which are mounted at the side portions and having a much large diameter than that of the string passage apertures.

7. The sports shoe of claim 6, in which the string passage rings are formed in a circular shape in at least those parts of the rings which engage the shoe string in order to make the shoe string smoothly engage the string passage rings.

8. The sports shoe of claim 7, in which the passage rings are formed in a D-shaped configuration with a semicircular portion which is to be engaged with the shoestring.

9. The sports shoe of claim 7 or 8, in which a string passage aperture is located at the lowermost part of each of the side portions.

10. The sports shoe of claim 7 or 8, in which string passage apertures are located at the uppermost part and the lowermost part of each of the side portions.

11. The sports shoe of claim 7, in which a string passage aperture is located at the uppermost part of each of the side portions.

12. The sports shoe of claim 7, in which the string passage ring engaging the shoe string has a free portion which is separated from the side portion and is movable relative to the side portion.

* * * * *